United States Patent [19]

Riviere

[11] Patent Number: 4,820,100

[45] Date of Patent: Apr. 11, 1989

[54] METHOD OF FITTING A TOP OR A BOTTOM TO THE BODY OF A CAN AND MACHINE FOR EXECUTING THIS METHOD

[75] Inventor: Maurice Riviere, Bois D'Arcy, France

[73] Assignee: Carnaud S.A., Boulognesur Seine, France

[21] Appl. No.: 70,443

[22] Filed: Jul. 7, 1987

[30] Foreign Application Priority Data

Jul. 8, 1986 [FR] France ..... 86 09897

[51] Int. Cl.[4] ..... B21D 51/32

[52] U.S. Cl. ..... 413/6; 413/30; 413/31

[58] Field of Search ..... 413/6, 31, 35, 36, 38, 413/40, 41, 42, 43, 30

[56] References Cited

U.S. PATENT DOCUMENTS

| | | | |
|---|---|---|---|
| 1,598,170 | 8/1926 | Stuart et al. | 413/30 |
| 1,615,325 | 1/1927 | Cameron | 413/31 |
| 1,636,839 | 7/1927 | Schrader | 413/31 |
| 1,679,629 | 8/1928 | Rollman . | |
| 2,281,574 | 5/1942 | Gladfelter . | |
| 2,536,055 | 1/1951 | Heinle | 413/31 |
| 3,246,622 | 4/1966 | Negoro . | |
| 3,452,897 | 7/1969 | Anthony et al. | 220/67 |
| 3,965,834 | 6/1976 | Dolveck . | |
| 4,241,844 | 12/1980 | Dolveck | 220/67 |
| 4,361,246 | 11/1982 | Nelson | 220/67 |

FOREIGN PATENT DOCUMENTS

| | | |
|---|---|---|
| 491495 | 6/1919 | France . |
| 2220742 | 10/1974 | France . |
| 2585332 | 1/1987 | France . |
| 330690 | 6/1930 | United Kingdom . |

*Primary Examiner*—Frederick R. Schmidt
*Assistant Examiner*—Robert Showalter
*Attorney, Agent, or Firm*—Sughrue, Mion, Zinn, Macpeak, and Seas

[57] ABSTRACT

In a method of fitting a top or a bottom to the body of a can, the top or bottom is placed inside a die having a rolling surface. The top or bottom has an inwardly rolled edge defining a support surface adapted to be substantially mated with at least part of the rolling surface. An end portion of the can body is inserted between this rolling surface and this support surface. Thrust is then applied to the can body until it causes the end portion to roll around and envelop the support surface. The corresponding machine comprises at least one rolling die incorporating a bush defining a first rolling surface facing radially inwards and a plurality of jaws disposed along a perimeter corresponding to the shape of the can. The jaws are movable towards an inside wall of this bush and are shaped to define at least part of a second rolling surface which faces radially outwards. This second rolling surface is adapted to form an extension of the first rolling surface when the jaws are positioned close to the inside wall of the bush.

8 Claims, 3 Drawing Sheets

18
21
20
22
20a
12a
12
29
30
13
19
31
34

METHOD OF FITTING A TOP OR A BOTTOM TO THE BODY OF A CAN AND MACHINE FOR EXECUTING THIS METHOD

BACKGROUND OF THE INVENTION

1. Field of the Invention

The invention concerns a method for fitting a top or a bottom to the body of a can, by internal rolling; it also concerns a machine for executing this method.

2. Description of the Prior Art

Many cans, at least partly in metal, are made by peripheral crimping forming a bead projecting circumferentially at the ends of the can. This bead is an area especially sensitive to corrosion (formation of rust when the can is left in a moist place, such as a bathroom, for example). Also, the esthetic result is poor, which may constitute a disadvantage for some articles such as perfumery products sold in aerosol type containers. In this specific area where the decoration of the packaging is important to promoting the product the presence of the bead interrupts the decoration and emphasizes in an unesthetic way the end of the package. Also, because the crimping process is applied after the body of the can is decorated by painting and varnishing it, known crimping tools damage the coating, which is one reason for the vulnerability of this area to corrosion. Finally, the presence of the external bead prevents stacking of such metal packages, which raises problems for storing and handling them.

Attempts have been made to produce an internal, non-projecting crimp, as evidenced by U.S. Pat. No. 3,452,897, for example. At the time of writing, however, there would not seem to have been any industrial exploitation of this type of crimp. Furthermore, using it entails soldering before the operations which lead to the formation of the internal crimp, which substantially increases manufacturing costs.

The invention makes it possible to remedy these disadvantages by proposing a new method of fitting a top or a bottom to the body of a can producing an internal crimp with no bead projecting from the periphery of the corresponding end of the can. The basic idea of the invention is to use a rolled edge preformed on said top or bottom as a support or reaction surface during internal rolling of the end portion of the can body.

SUMMARY OF THE INVENTION

In one aspect, the invention consists in a method of fitting a top or a bottom to the body of a can, wherein there is placed inside a die having a rolling surface a top or a bottom having an inwardly rolled edge that defines a support surface adapted to be substantially mated with at least part of said rolling surface, an end portion of said can body is inserted between said rolling surface and said support surface and a thrust is applied to said can body until it causes said end portion to become rolled, enveloping said support surface.

In another aspect, the invention consists in a machine for fitting a top or a bottom to the body of a can, comprising at least one rolling die incorporating a bush defining a first rolling surface facing radially inwards and a plurality of jaws disposed along a perimeter corresponding to the shape of the can and adapted to be movable towards an inside wall of said bush, said jaws being shaped to define at least part of a second rolling surface facing radially outwards and adapted to form an extension of said first rolling surface when said jaws are positioned close to said inside wall of said bush.

The invention will be better understood and other advantages of it will emerge more clearly from the following description given by way of example only and with reference to the appended schematic drawings.

DESCRIPTION OF THE PREFERRED EMBODIMENT

Figure 8:
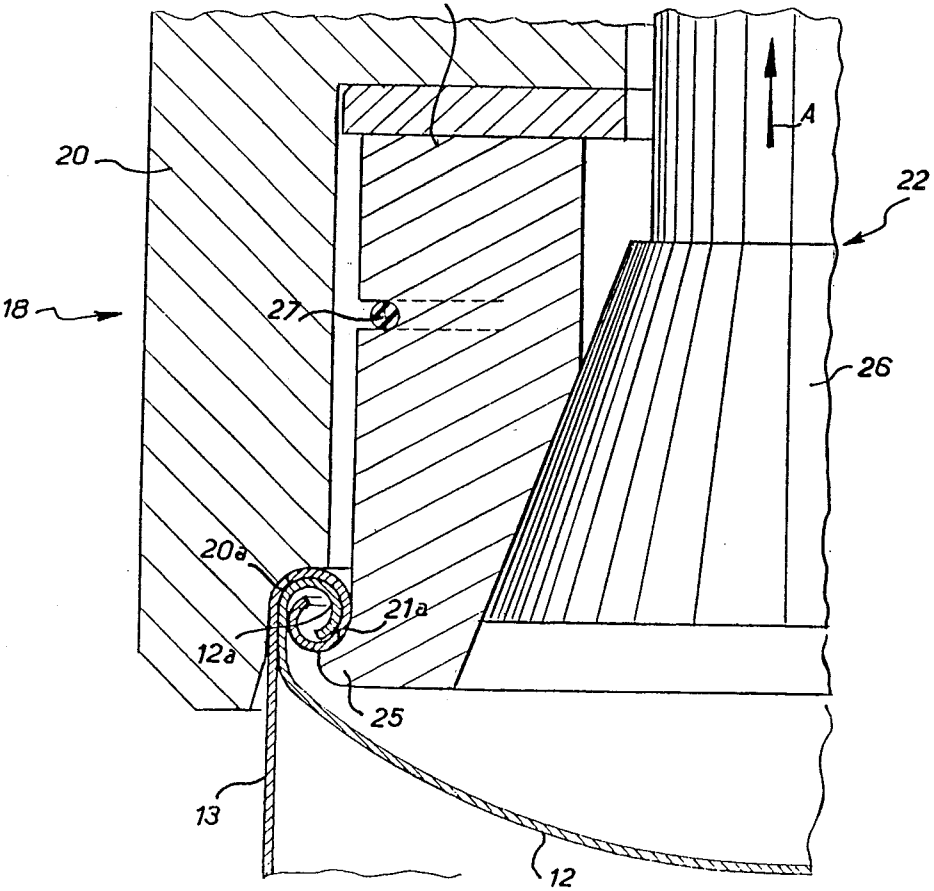
FIG. 8 is a detail view to a larger scale showing in particular the internal rolling operation corresponding to FIG. 5.

Referring to the drawings, there is shown a machine 11 for fitting tops or bottoms 12 to respective tubular can bodies 13. This machine primarily comprises a drum 14 rotating about its main axis 15 in order to sequence the various operations and in this instance carrying four assemblies 16 each comprising a rolling die 18 and piston 19. These four assemblies are regularly disposed at the periphery of the drum and offset angularly relative to each other by 90°. Each rolling die 18 comprises a generally bell-shaped bush 20 containing jaws 21 movable radially by a plunger 22 having a bearing surface the cross-section of which varies axially and which is movable along an axis parallel to the arrow A (FIG. 8). In the example shown, which concerns the fitting of circular bottoms to cylindrical can bodies, the bush 20 has a circular bottom opening and the jaws 21 are arranged regularly and circumferentially inside said bush, the bearing surface of variable cross-section being in this instance a frustoconical bearing surface 26. It is to be understood, however, that these shapes are conditioned merely by that of the crimping contour. Depending on the shape of the can, the shape of the bush, the arrangement of the jaws and the shape of the plunger could be substantially different without departing from the scope of the invention, the necessary structural modifications lying within the competence of those skilled in the art.

According to an important characteristic of the invention, the rolling surface is divided within the die 18 between the inside surface of the bush 20, in the vicinity of its bottom opening, and surface portions of the jaws 21. To be more precise, the bush 20 defines a first rolling surface **20*a* extending radially inwards from the edge of its opening and having an appropriate curved radial profile, whereas each jaw 21 has a curved profile surface 21*a* extended in its lower part by a small projecting bead 25. The set of surfaces 21*a* thus forms a second rolling surface, discontinuous in the circumferential direction, generally oriented outwardly and forming an extension of said first rolling surface 20*a* when said jaws are placed near the inside wall of said bush, due to the action of the plunger 22. This situation is clearly visible in FIG. 8. It can be seen that the jaws are pushed radially outwards when the plunger is moved axially in the direction of the arrow A, that is to say when its frustoconical bearing surface 26 pushes the set of jaws radially outwards, bearing against their rear surfaces. An elastic ring 27 of elastomer material is placed in a housing defined by groove sections formed on the outside of the jaws so as to urge the latter in the direction of radial withdrawal when the plunger is moved in the direction opposite that indicated by the arrow A. Also, the lower part of the plunger carries holding means 29, here in the form of a sucker, adapted to hold a top or bottom 12. The security of holding by the sucker is improved by suction means (not shown) sequentially connected to a conduit 30 passing axially through the plunger 18 and discharging at the center of said sucker 29**.

Figure 1:
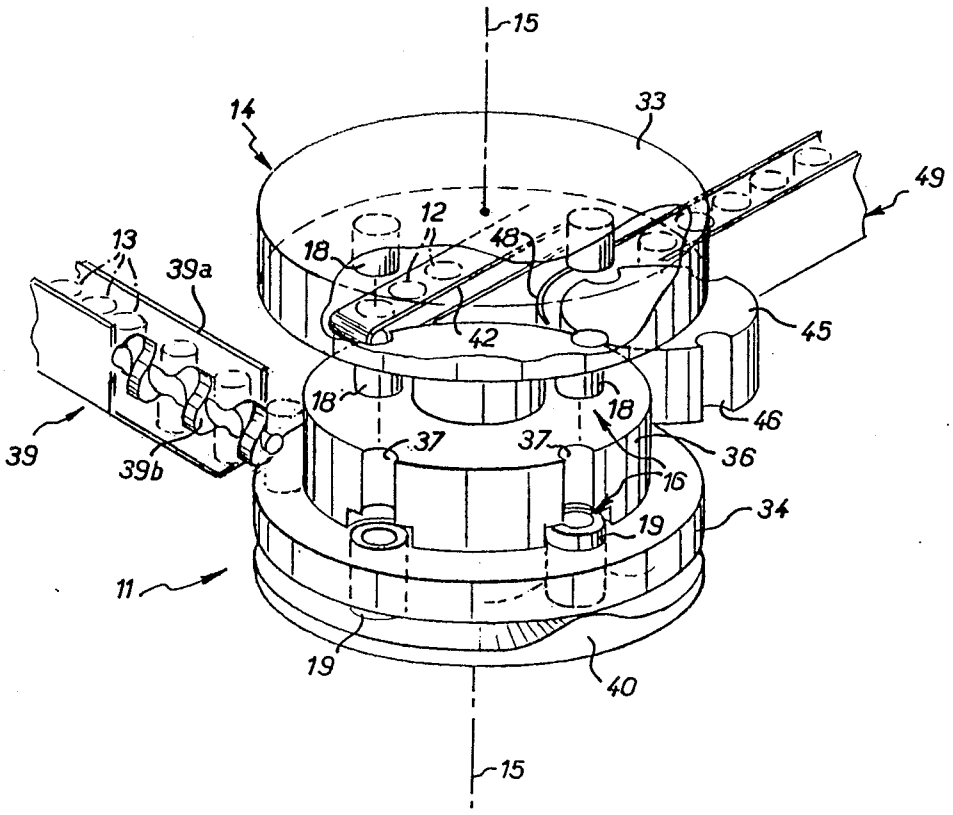
FIG. 1 is a schematic view in perspective of a machine for fitting a top or a bottom to the body of a can by executing operations in accordance with the invention.
Figures 2, 3, 4, 5, 6:
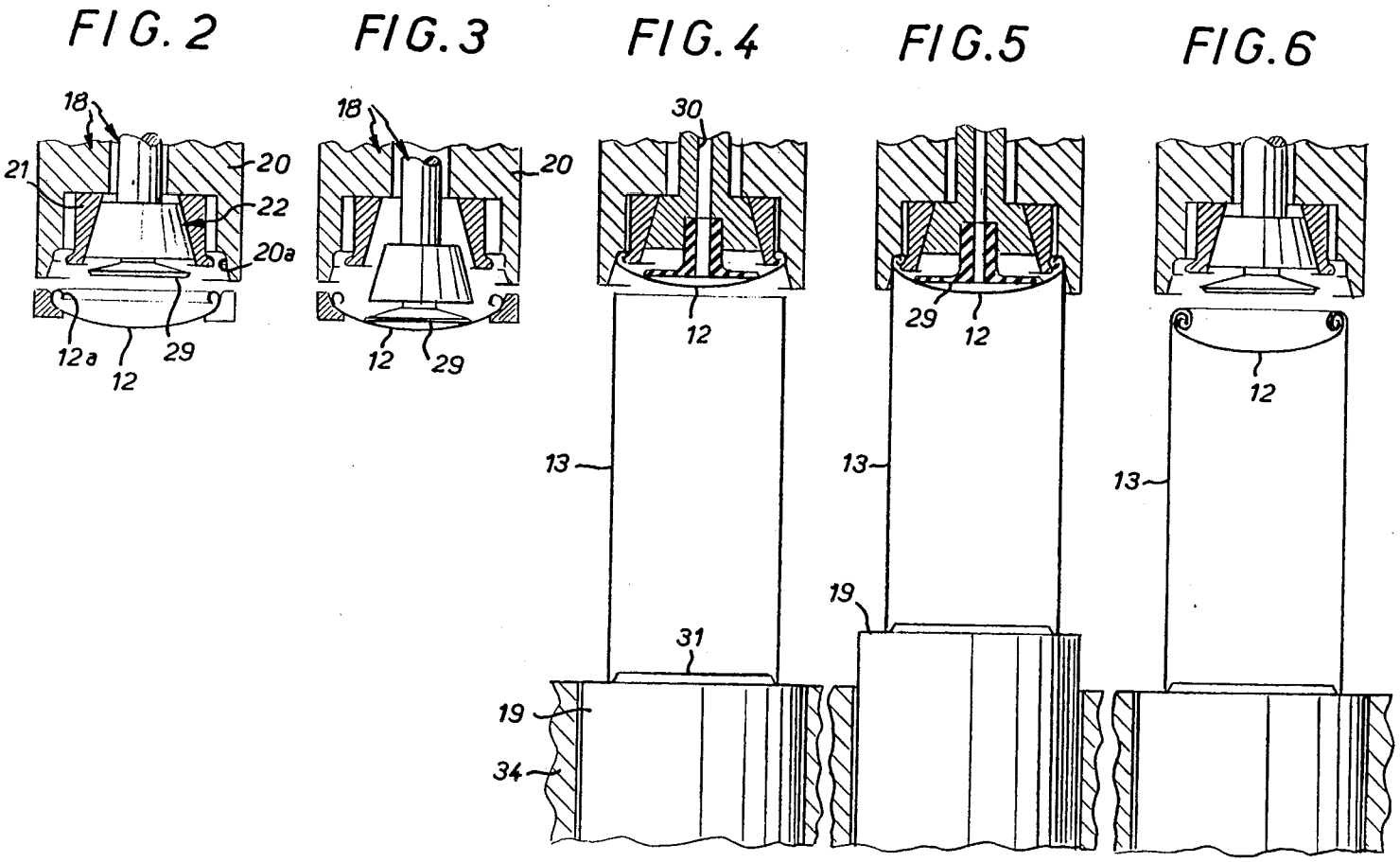
FIGS. 2 through 6 are detail views partially in cross-section of certain parts of the machine from FIG. 1 and showing the sequence of operations carried out by said machine.
Figure 7:
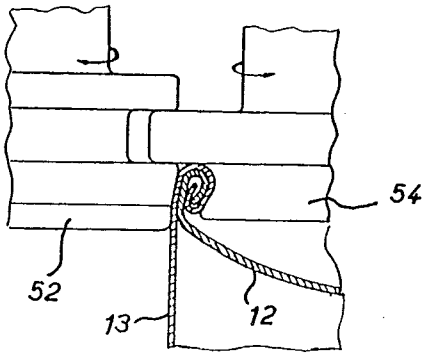
FIG. 7 illustrates the last stage of the process carried out at another workstation independent of the machine from FIG. 1.

Each rolling die 18 is disposed above a piston 19, the axis of symmetry of which is aligned with the axis of the plunger. This piston is shaped to receive a can body 13 vertically, that is to say with an axial end of said can body resting on the upper surface of the piston. To this end the latter is provided with a slight relief 31 of disc shape the diameter of which corresponds to the inside diameter of the can body. The piston is movable along the actuation axis of the plunger, that is to say vertically in this instance. To be more precise, the drum 14 primarily comprises two horizontal plates 33 and 34 spaced from each other and separated by a cylindrical part 36 of smaller diameter. The lower plate 34 accommodates the pistons 19 in corresponding bores and the lower surfaces of these pistons project from the lower surface of the plate so as to be able to engage a fixed lifting ramp 40 or some analogous actuator means. The upper plate 33 carries the dies 18 aligned with the pistons 19. The cylindrical part 36 is provided with semi-cylindrical hollows 37 in the side, the shape and size of which are adapted to receive and drive can bodies 13. These are inserted between the plates 33 and 34 by conveyor means 39 provided with a slideway **39*a* and a coarse threaded screw 39*b* driving said can bodies. The tops or bottoms 12 are also inserted between the plates 33 and 34, by appropriate further conveyor means 42, in this instance in the form of a conveyor belt. The end parts of the conveyor means 39 and 42 are arranged substantially tangentially to the drum 14, between the plates 33 and 34. An auxiliary take-off cylinder 45 provided with semi-cylindrical hollows 46 in its side is rotatably mounted in the vicinity of the periphery of the cylindrical part 36. It is rotated synchronously with the drum 14 and cooperates with a guide 48 to deposit the can bodies fitted with their top or bottom onto conveyor means 49 which carry them to a crimping station shown in FIG. 7. This is conventional and essentially comprises two knurled wheels 52, 54 between which the inside roll fastening together the can body 13 and the top or bottom 12** is crushed radially to seal the assembly.

The implementation of the method in accordance with the invention will now be described more particularly as illustrated in FIGS. 2 through 6.

It should be noted that the tops or bottoms 12 which are conveyed towards the dies 18 are preformed so that each has an inwardly rolled edge **12*a*. This rolled edge may be obtained in the conventional way by stamping, using an appropriately shaped tool, which it has not been considered necessary to show, as this operation is in itself banal. The tops or bottoms 12 preformed in this way are deposited on the conveyor means 42 so that said rolled edges 12*a* are oriented towards the plate 33 when the tops or bottoms reach the end of said conveyor means. The movement of the latter is synchronized to the rotation of the drum 14 so that a top or bottom 12 arrives below a die 18 in the situation shown in FIG. 2. The plunger 22 is then lowered until the holding means 29 comes into contact with the center part of the top or bottom 12. This is the situation illustrated in FIG. 3. At this stage of the process the jaws 21 are retracted relative to the inside surface of the bush 20, since the frustoconical bearing surface 26 is not in contact with said jaws. When the top or bottom 12 adheres to the sucker the plunger 22 is actuated in the direction of the arrow A, the two-fold consequence of which is to place the rolled edge 12*a* opposite said first rolling surface 20*a* and then to bring about radial displacement of the jaws 21 so as to trap the rolled edge 12*a* completely in the annular space defined between the rolling surfaces 20*a* and 21*a*. It should be noted that from this time the top or bottom 12 is trapped by its rolled edge in the die 18 but that it is not in practise subjected to any clamping force between the inside surface of the bush 20 and the jaws 21. The drum 14 then continues to rotate as far as the end of the conveyor means 39 where a can body 13 is positioned on the corresponding piston 19. This is the situation shown in FIG. 4. Rotation of the drum continues until the piston 19 is actuated upwards as it passes over the ramp 40. This is the situation shown in FIGS. 5 and 8 and its consequence is to insert the upper end portion of the can body between the rolling surfaces 20*a*, 21*a* and a supporting surface defined by the rolled edge 12*a* of the top or bottom itself. The consequence of this movement is to thrust the can body 13 axially until its end portion inserted into the die rolls around and envelops the supporting surface defined by the rolled edge 12*a*. From this moment on the top or bottom 12 and the can body 13 are fastened to each other. The sucker 29 is released and the piston 19, passing beyond the ramp 14, redescends into its housing. This is the situation of FIG. 6. As rotation continues, the assembly reaches the conveyor means 49 which feeds the clamping station shown in FIG. 7. The rolled portions of the can body and the top or bottom are then clamped radially until said rolled portions are crushed between the two knurled wheels 52 and 54**. This latter operation produces a perfectly sealed crimp, without previous soldering.

The invention is applicable to fitting a deformable but not necessarily metal top or bottom to a metal can body.

I claim:

1. Method of fitting, without soldering or welding, a circular can top or bottom to the cylindrical straight-walled body of a can, said body having a longitudinal axis, said method comprising the steps of: placing inside a die having a rolling surface a circular can top or bottom having a preformed radially inwardly rolled edge that defines a circumferential support surface adapted to be substantially mated with at least part of said rolling surface; then inserting an unrolled circular end portion of said can body between said rolling surface and said support surface; and then axially thrusting said can body into said die, and said end portion against said rolling surface, to cause said end portion to become radially inwardly rolled and to envelop said support surface.

2. Method according to claim 1, further comprising then radially clamping said rolled portions of said can body and said top or bottom until said rolled portions are crushed.

3. Method according to claim 2, wherein said clamping is produced by means of two rotating knurled wheels.

4. Machine for fitting a circular can top or a bottom to the cylindrical body of a can, comprising: at least one rolling die incorporating a bush, defining a first rolling surface facing radially inwards, and a plurality of jaws disposed along a perimeter corresponding to the shape of the can and adapted to be movable towards an inside wall of said bush, said jaws being shaped to define at least part of a second rolling surface facing radially outwards and adapted to form an extension of said first rolling surface when said jaws are positioned close to said inside wall of said bush; plunger means for placing between said first and second rolling surfaces a preformed radially inwardly rolled edge of a can top or bottom; and piston means for supporting the can body for axially thrusting same into said die, and an unrolled end portion of the body into engagement with said rolling surfaces, to cause said end portion to become radially inwardly rolled and to envelop said rolled edge.

5. Machine according to claim 4, wherein said plunger means comprises a plunger that is axially movable within said bush and includes a bearing surface the cross-section of which varies in the axial direction, said bearing surface cooperating with said jaws to thrust them towards said inside wall of said bush, and wherein said plunger has a lower part incorporating holding means adapted to hold a can top or bottom.

6. Machine according to claim 5, wherein said holding means comprise a sucker.

7. Machine according to claim 5, wherein said piston means comprises die, and an unrolled piston below said rolling die shaped to receive a can body and movable along the actuation axis of said plunger.

8. Machine according to claim 7, further comprising at least one rolling die/piston assembly, a drum on the perimeter of which said at least one assembly is placed and means for actuating said piston disposed near the periphery of said drum and on the path of movement of said piston.

* * * * *